US006729704B2

(12) United States Patent
Ames

(10) Patent No.: US 6,729,704 B2
(45) Date of Patent: May 4, 2004

(54) REMOVABLE GLASS ENCAPSULATED SHELVES

(75) Inventor: Shannon Wayne Ames, Olympia, WA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/742,547

(22) Filed: Dec. 22, 2000

(65) Prior Publication Data

US 2003/0132691 A1 Jul. 17, 2003

(51) Int. Cl.[7] ..... A47B 96/02
(52) U.S. Cl. ..... 312/408
(58) Field of Search ..... 312/401, 404, 312/408, 410, 334.44, 334.46, 351; 108/106, 107, 108; 211/153, 90.01

(56) References Cited

U.S. PATENT DOCUMENTS 2,997,356 A 8/1961 Hilliker et al.
3,690,744 A 9/1972 Squire
3,984,163 A 10/1976 Boorman, Jr. et al.
5,340,209 A 8/1994 Kolbe et al.
5,346,299 A * 9/1994 Werkmeister et al. ... 312/405.1
5,516,204 A 5/1996 Calvert et al.
5,524,981 A 6/1996 Herrmann et al.
5,540,493 A 7/1996 Kane et al.
5,735,589 A 4/1998 Herrmann et al.
5,813,741 A 9/1998 Fish et al.

FOREIGN PATENT DOCUMENTS

CH 372323 * 11/1963 ..... 312/408

* cited by examiner

*Primary Examiner*—James O. Hansen
(74) *Attorney, Agent, or Firm*—H. Neil Houser, Esq.; Armstrong Teasdale LLP

(57) ABSTRACT

An extendible refrigerator shelf assembly includes a shelf and a support frame including gussets forming shelf stops to engage forward tabs laterally extending from the shelf. The support frame includes side supports having a sliding surface of different widths to retain and release the forward and rear tabs of the shelf. In an extended position, a front edge of the shelf may be lifted to release the front tabs, and the shelf may pulled slightly outward until the rear tabs reach a release position where they may be lifted through the side support ledges.

8 Claims, 4 Drawing Sheets

REMOVABLE GLASS ENCAPSULATED SHELVES

BACKGROUND OF THE INVENTION

This invention relates generally to shelves and, more particularly, to extendible shelves for use in refrigerators.

One type of extendible or "slide-out" refrigerator shelf assembly includes slide mechanisms and latch springs that engage a portion of a shelf when the shelf is in an extended position. The latch springs restrict movement of the shelf beyond a predetermined position and releasably hold the shelf in an extended position. See, for example, U.S. Pat. No. 5,340,209.

Removal of slide out refrigerator shelves, however, is problematic because the slide mechanisms for the shelves must support the shelf in a fully or partially extended position and thus must securely couple the shelf to shelf supports. Consequently, removal or separation of the shelf from the supports is intricate and often awkward. Some removable slide-out shelves require extension of the shelf substantially beyond a normal fully extended position to release the shelf from the shelf supports, which is further problematic when a space or clearance for opening of a refrigerator door is restricted.

Accordingly, it would be desirable to provide securely mounted and easily extendible slide-out shelves that are easily removed even when the opening of a refrigerator door is restricted.

BRIEF SUMMARY OF THE INVENTION

In an exemplary embodiment, a removable slide-out refrigerator shelf includes a shelf having laterally extending forward tabs and laterally extending rear tabs, and extended refrigerator shelf supports including gussets which act as shelf stops. The shelf slides upon ledges in the side supports, and the forward and rear tabs extend from the shelf below the ledge to couple the ledge to the shelf. The side support ledges include a forward portion having a width allowing the forward tab to be deliberately separated from the supports with ease when the shelf is fully extended by lifting a front edge of the shelf, and center and rear portions of greater width to secure the forward and rear tabs, respectively, of the shelf to the supports and prevent inadvertent separation of the shelf from the shelf supports during movement of the shelf between extended and retracted positions.

More specifically, the shelf is extended until the forward tabs contact the gusset stops. From this position the shelf may be lifted upward to elevate the forward tabs over the gusset stops and through the forward portions of the support ledges, thereby releasing the forward tabs. The rear tabs, however, remain engaged to the shelf supports via the rear portions of the support ledges having a width sufficient to prevent the rear tabs from being lifted through the support ledge rear portions. With slight outward extension of the shelf once the forward tabs are disengaged from the gusset stops, the rear tabs are positioned within the center portions of the support ledges having a width allowing the rear tabs to be lifted through the center portions of the support ledges to completely remove the shelf from the side supports.

The shelf rear tabs are positioned relative to the forward tabs so that the rear tabs are located near the support ledge center portions when the forward tab contacts the gusset stops and the shelf is in a fully extended position. Therefore, once the forward tabs are disengaged, a small additional clearance is required to extend the shelf until the rear tabs reach the support ledge center portions where they may be separated from the side supports. Therefore, a secure extendible refrigerator shelf is provided that is quickly and easily removed from shelf supports even when clearance is restricted.

DETAILED DESCRIPTION OF THE INVENTION

Figure 1:
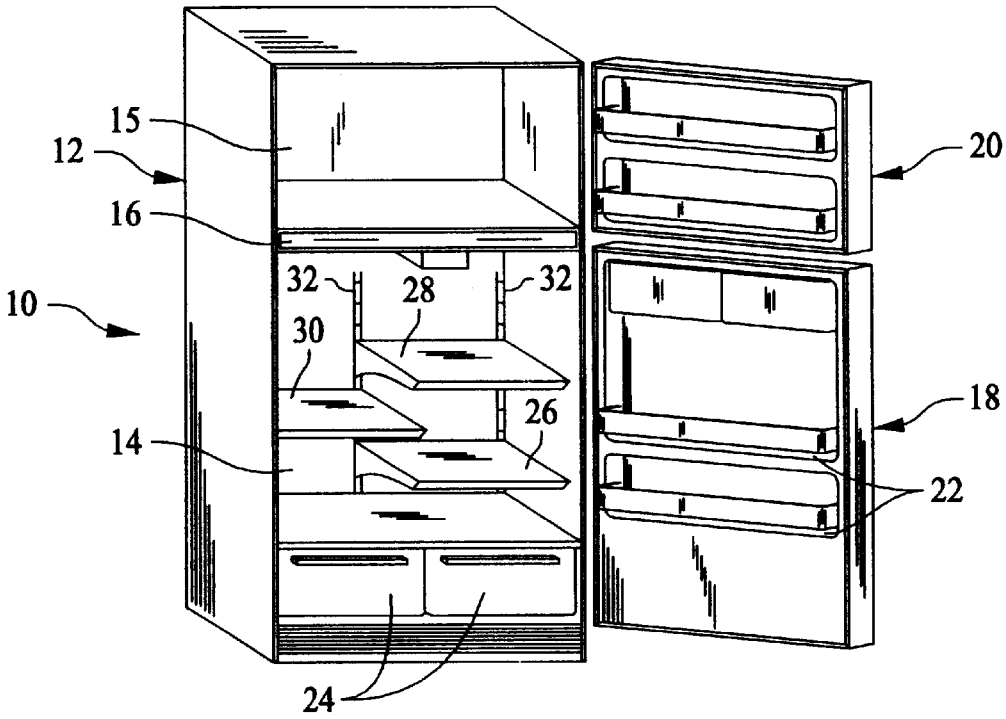
FIG. 1 is a front perspective view of an exemplary refrigerator including an exemplary slide out shelf assembly.

FIG. 1 is a perspective view of an exemplary large top mount refrigerator 10 including an outer cabinet 12 including a fresh food compartment 14 and a freezer compartment (not shown) separated by an internal wall 16. A fresh food door 18 and a freezer door 20 provide access to fresh food compartment 14 and to the freezer compartment, respectively. Fresh food door 18 typically includes a number of shelves 22 for storage of foodstuffs. A number of storage drawers 24 are provided in the lower portion of fresh food compartment 14, and a plurality of vertically adjustable shelf assemblies 26, 28 and 30 on two tracks 32 are provided in the upper portion of fresh food compartment 14. Shelf assembly 28 is a slide-out shelf assembly in a retracted position, and is selectively positionable from a retracted position (shown in FIG. 1) to an extended position (described below) to allow more convenient access to items placed upon shelf assembly 28.

While described and illustrated in the exemplary context of a middle shelf of a top mount refrigerator, it is contemplated that shelf assembly 28 could be used in other applications, including but not limited to other types of refrigerators, such as side-by-side refrigerators, as well as slide-out shelves, drawers, and bin assemblies for use in a wide variety of products of general application. As the benefits of the present invention accrue to uses well beyond use as a refrigerator shelf, the present invention is not limited to specific application in a refrigerator, such as, for example, refrigerator 10.

Figure 2:
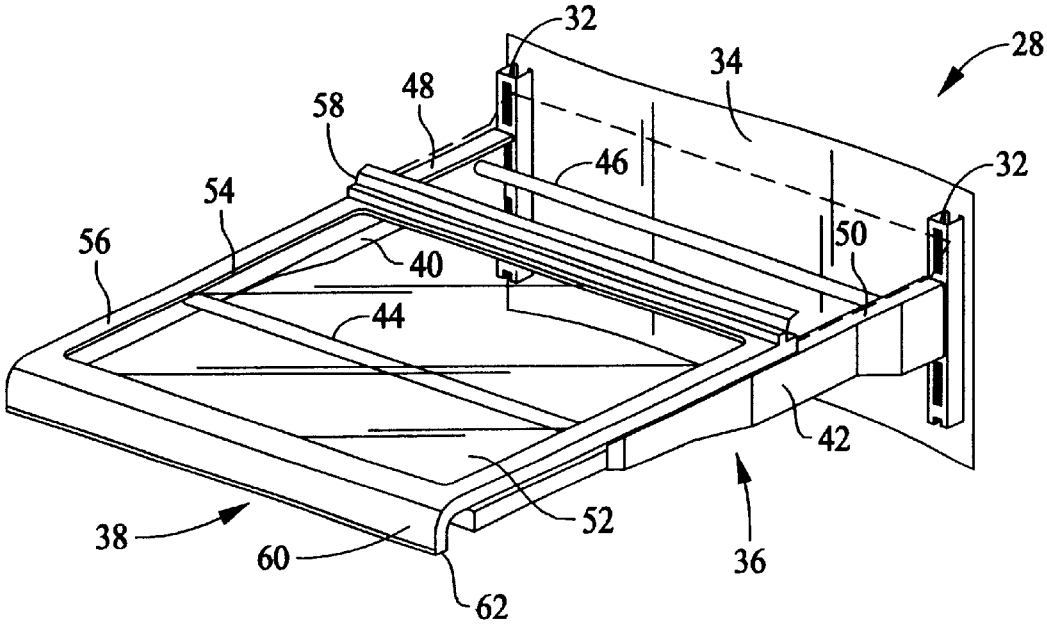
FIG. 2 is a perspective view of the exemplary slide-out shelf assembly shown in FIG. 1 in an extended position.

FIG. 2 is a perspective view of shelf assembly 28 in an extended position. Shelf assembly 28 is mounted on rails or tracks 32 attached to a rear wall 34 of fresh food compartment 14 (shown in FIG. 1). Shelf assembly 28 includes a support frame 36 and a glass encapsulated shelf 38. Frame 36 includes two side supports 40 and 42, a front cross rod 44 and a rear cross rod 46. Each of side supports 40 and 42 include an inwardly projecting flange ledge 48 and 50, respectively, upon which shelf 38 slides. Shelf 38 includes a rectilinear transparent plate 52 held within grooves 54 of a surrounding rim 56 fabricated from a suitable plastic material such as, for example, acrylonitrile-butadiene-styrene (ABS). An anti-spill guard 58 is positioned across the rear of rim 56 and is integral with rim 56. In an alternative embodiment, guard 58 is a separate piece from rim 56, including, but not limited to, a clip on piece. A front edge 60 of rim 56 is curved downwardly to form a handle 62 which a user may grasp to move shelf 38 between the extended position and the retracted position (shown in FIG. 1) wherein anti-spill guard 58 is positioned substantially adjacent rear wall 34.

Figure 3:
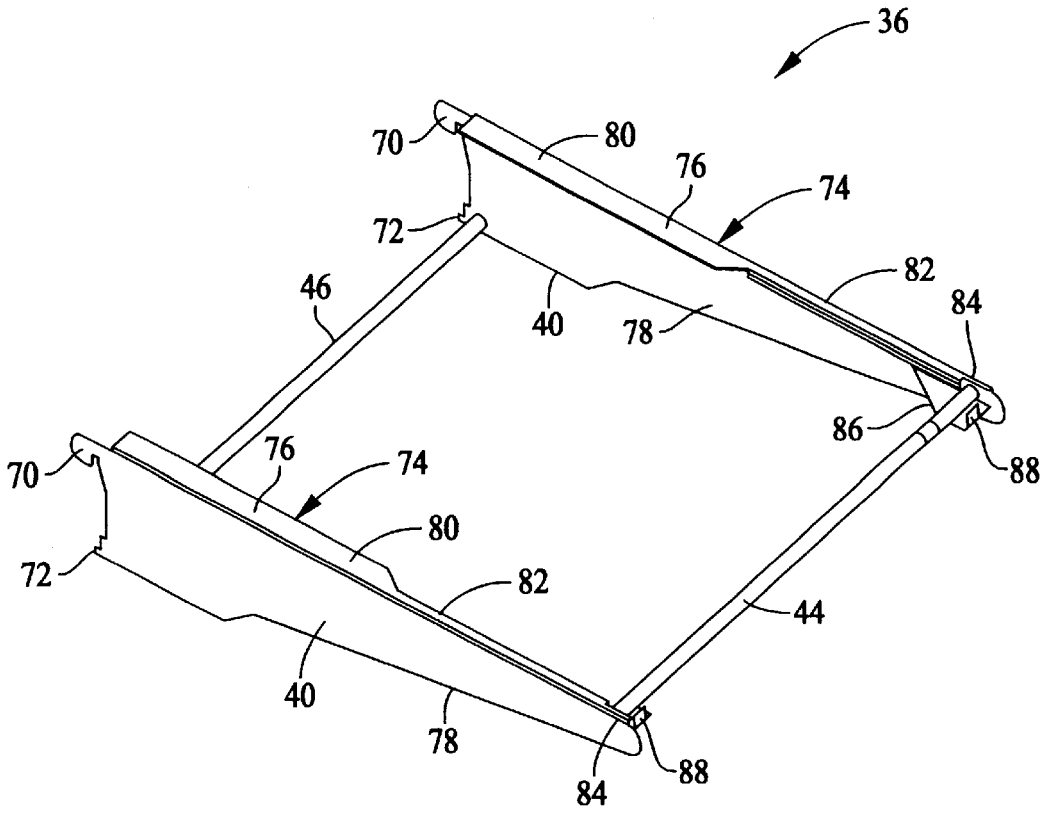
FIG. 3 is a top perspective view of the support frame shown in FIG. 2.

FIG. 3 is a top perspective view of support frame 36. Side supports 40 and 42 include hooks 70 and projections 72 for engagement with vertical tracks 32 (shown in FIG. 2) to hold shelf assembly 28 (shown in FIG. 2) at a selected elevation. Each side support 40, 42 further includes a horizontally inwardly projecting doubly stepped upper flange or ledge 74 forming a surface 76 upon which shelf 38 (shown in FIG. 2) may slide. An inner surface 78 of supports 40, 42 is substantially perpendicular to ledges 74, and shelf 38 is retained to side supports 40, 42 partially above and partially below ledges 74 and between inner surfaces 78 as described further below.

Each ledge 74 includes a rear portion 80 having a first width, a center portion 82 having a second width smaller than the first width, and a forward portion 84 having a third width smaller than the second width. Gussets 86 extend laterally inward from side frames 40 and 42 and include integral tabs 88 extending upwardly from gussets 86. Cross rods 44, 46 rigidly connect side supports 40 and 42, and cross rod 44 is bent upwardly so that it is hidden by shelf 38 in the retracted position (shown in FIG. 1).

Figure 4:
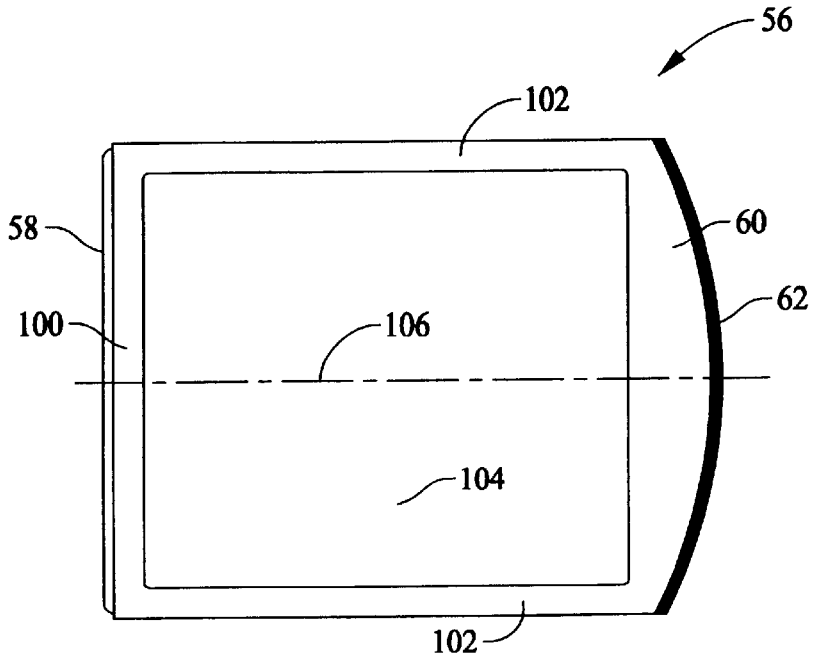
FIG. 4 is a top plan view of the shelf rim shown in FIG. 2.

FIG. 4 is a top plan view of shelf rim 56 including front edge 60, a rear edge 100, and two side edges 102 forming an enclosure 104 to contain transparent plate 52 (shown in FIG. 2). Front edge 60 includes rounded handle 62, and rear edge 100 includes anti-spill guard 58. In one embodiment, rim 56 is substantially symmetrical about a longitudinal axis 106.

Figure 5:
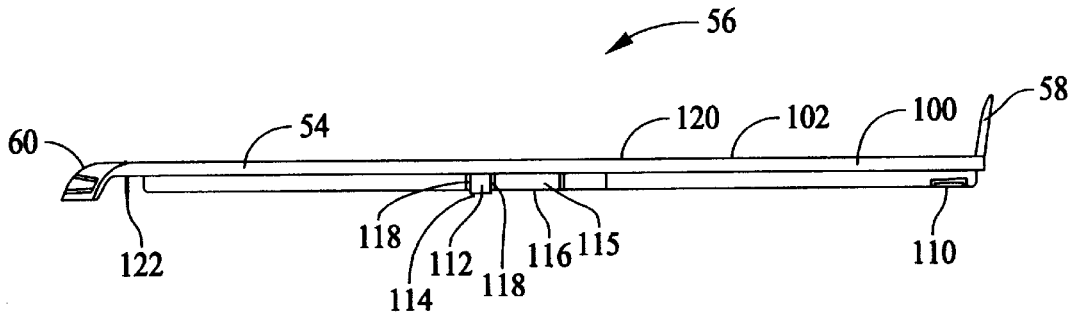
FIG. 5 is a longitudinal end view of the shelf rim shown in FIG. 4.

FIG. 5 is a longitudinal end view of shelf rim 56 including three lateral projections, namely, a rear tab 110, a centering lug 112 and a forward tab 114 extending from side edge 102 below groove 54 for receiving transparent plate 52 (shown in FIG. 2). Forward tab 114 extends laterally outward, i.e., away from shelf longitudinal axis 106 (shown in FIG. 4) from a lower portion 115 of side edge 102 for a first distance and extends slightly below a bottom 116 of side edge 102. Centering lug 112 includes sloped sides 118 to facilitate smooth movement of shelf 38 (shown in FIG. 2) between extended and retracted positions and provides support to front tabs 114. Sloped sides 118 prevent jamming of shelf 38 in side supports 40, 42 (shown in FIGS. 2 and 3) and gently direct shelf 38 into a proper centered position relative to side supports 40, 42 as shelf 38 is moved relative to support frame 36 (shown in FIGS. 2 and 3).

Rear tab 110 extends laterally outward i.e., away from shelf longitudinal axis 106 (shown in FIG. 4) from side edge lower portion 115 for a second distance less than the first distance for which forward tab 114 extends, and rear tab extends slightly above bottom 116 of side edge 102 adjacent rear edge 100. Anti-spill guard 58 extends obliquely from a top surface 120 of rim 56, and rounded front edge 60 extends downward from rim top surface 120. A stop 122 depends downwardly from groove 54 below side edge bottom 116. When shelf 38 (shown in FIG. 2) is in a fully retracted position, stop 122 contacts support frame cross rod 44 (shown in FIG. 3).

Figure 6:
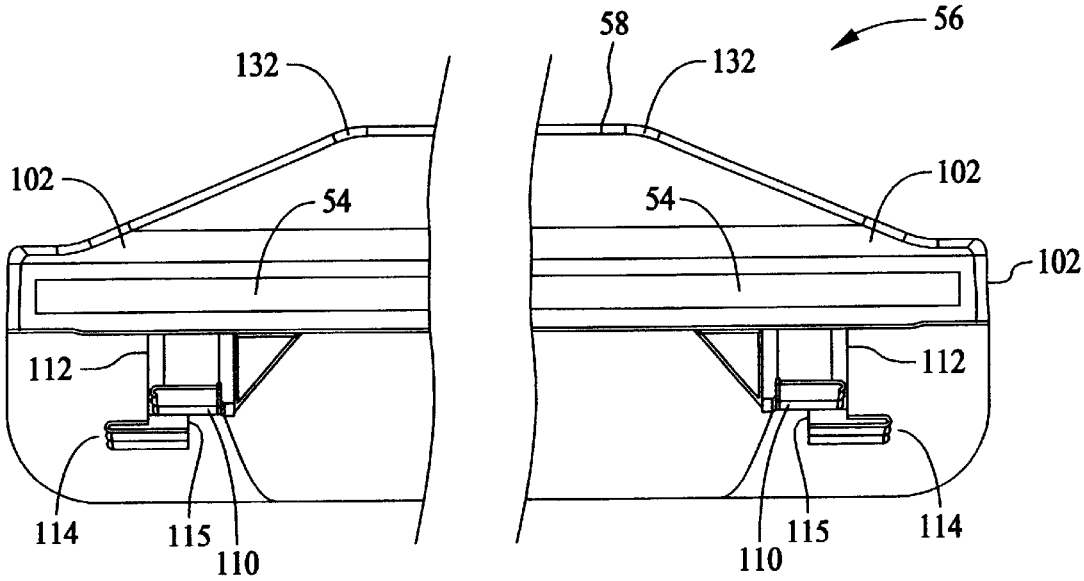
FIG. 6 is a partial rear view of the rim shown in FIG. 5.

FIG. 6 is a partial rear view of rim 56 illustrating side edge lower portions 115 extending downwardly from groove 54 that retains transparent plate 52 (shown in FIG. 2). Side edge lower portion 115 is inwardly spaced from upper portions of side edges 102 to form a sliding surface that rests upon surfaces 76 (shown in FIG. 3) of side support ledges 74 (shown in FIG. 3) when shelf 38 (shown in FIG. 2) is installed in support frame 36 (shown in FIGS. 2 and 3). Forward tabs 114 extend outwardly from side edge lower portions 115 a greater distance than centering lugs 112 and rear tabs 114. Anti spill guard 58 laterally extends above rim top surface 120 substantially the entire width of rim 56, and includes flared sides 132 to prevent jamming of anti-spill guard 58 when shelf 38 (shown in FIG. 2) is installed onto support frame 36 (shown in FIGS. 2 and 3).

Figure 7:
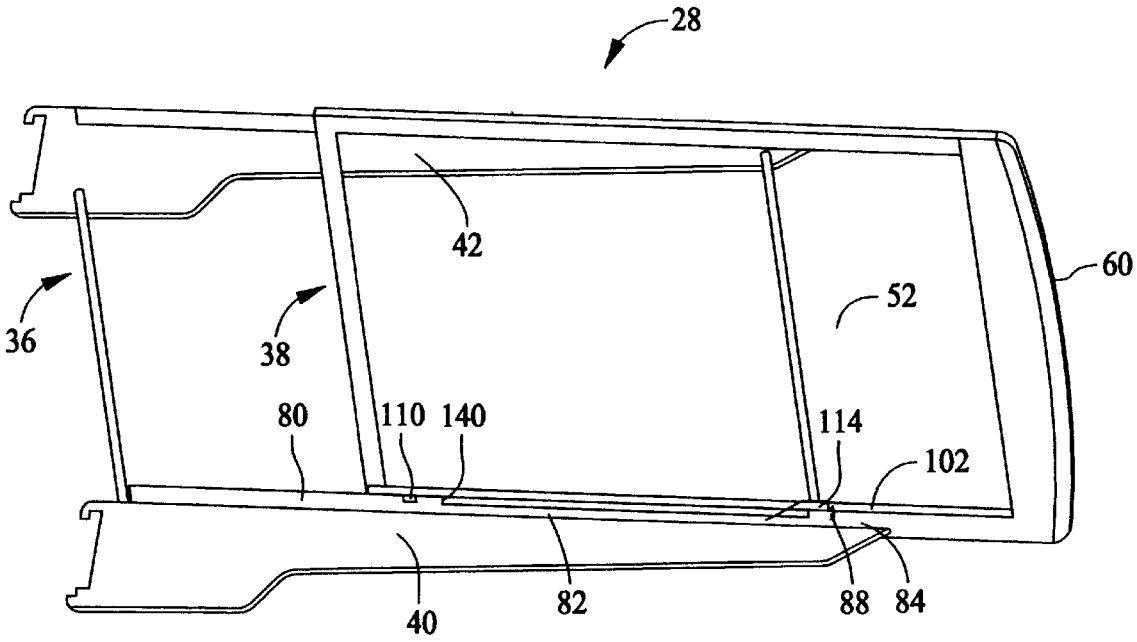
FIG. 7 is a top perspective view partially broken away of the shelf assembly shown in FIG. 2 in an extended position.
Figure 8:
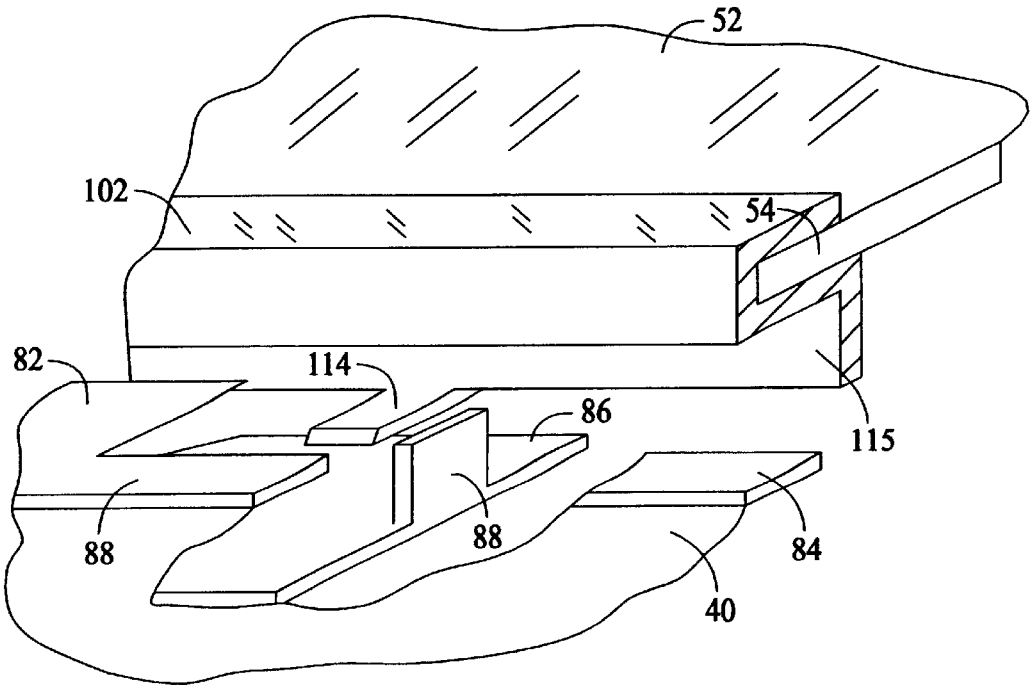
FIG. 8 is a magnified view of a portion of FIG. 7.

FIG. 7 is a top perspective view of shelf assembly 28 in the extended position with the left side edge 102 broken away, and FIG. 8 is a magnified view of a portion of FIG. 7 illustrating the release of shelf forward tab 114 from side support 40. When shelf assembly 28 is extended, forward tab 114 contacts gusset tab 88 and prevents further outward movement or extension of shelf 38. In the fully extended position, rear tabs 110 are positioned below side support ledge rear portion 80 and near a forward end 140 of side support ledge rear portion 80 so that shelf 38 is securely retained to side supports 40, 42. The proximity of rear tab 110 and side support ledge center portion 82 allows full release of shelf 38 with minimal additional extension of shelf assembly 28.

By lifting rim front edge 60 when shelf assembly 28 is in the fully extended position, forward tabs 114 of rim side edge lower portion 115 may be elevated over gusset tab 88 and forward tabs 114 released from side supports 40, 42 between forward ledge portions 84. By pulling shelf 38 longitudinally away from side supports 40, 42, shelf 38 quickly reaches a release position (not shown) in which rear tabs 110 are positioned forward of side support ledge rear portions 80 and within side support ledge center portions 82 that are dimensioned to provide a lateral clearance for rear tabs 110. Shelf 38 may therefore be released by lifting rear tabs 110 upward and through side support ledge center portions 82.

In one embodiment, a release position is provided that requires about two inches additional extension beyond the normal fully extended position, and more conveniently of about one inch, which is appreciably less than that required by known extendible shelves for release. Once the release position is obtained, shelf 38 may be fully removed from side supports 40, 42 by lifting shelf 38 upward and away from side supports 40, 42.

Return or installation of shelf 38 is accomplished by inserting rear tabs 110 in side support ledge center portions 82, elevating forward tabs 114 over gusset tabs 88 and sliding shelf 38 backward over side supports 40, 42 until rim stops 122 (shown in FIG. 5) contact gusset tabs 88 and shelf 38 is in a fully retracted position. Centering lugs 112 (shown in FIG. 5) guide shelf 38 and maintain shelf 38 properly centered between side support inner surfaces 78 (shown in FIG. 3) as shelf 38 is extended and retracted in use. Installation and removal of shelf 38 may be accomplished with one hand.

Thus, an extendible shelf assembly 28 is provided that securely couples shelf 38 to side supports 40, 42 while allowing a user to remove and reinstall shelf 38 from side supports 40, 42 quickly and easily as desired such as, for example, cleaning of shelf 38. The diminished extension required to place shelf 38 in the release position relative to known extendible shelf assemblies allows shelf 38 to be removed even in restricted access conditions.

While the invention has been described in terms of various specific embodiments, those skilled in the art will recognize that the invention can be practiced with modification within the spirit and scope of the claims.

What is claimed is:

1. A slide-out refrigerator shelf assembly comprising:

a shelf comprising a first side, a forward tab laterally extending a first distance from said first side, and a rear tab laterally extending a second distance from said first side, said second distance less than said first distance; and a first shelf side support mounted to a fresh food compartment rear wall of a refrigerator comprising a laterally projecting ledge for sliding engagement with said shelf first side, said projecting ledge comprising:

a rear portion having a first width sufficient to retain said rear tab;

a center portion having a second width less than said first width and providing a clearance for said rear tab; and a forward portion having a third width less than said second width, said third width providing a clearance for said forward tab.

2. A shelf assembly in accordance with claim 1 wherein said shelf forward tab is configured to be forward of said ledge rear portion and ledge center portion when said shelf is in a first extended position.

3. A slide-out refrigerator shelf assembly comprising:

a shelf comprising a first side, a forward tab laterally extending a first distance from said first side, and a rear tab laterally extending a second distance from said first side, said second distance less than said first distance; and a first shelf side support comprising a laterally projecting ledge for sliding engagement with said shelf first side, said projecting ledge comprising:

a rear portion having a first width sufficient to retain said rear tab;

a center portion having a second width less than said first width and providing a clearance for said rear tab, wherein said second width is sufficient to retain said forward tab when said forward tab is positioned in said center portion; and a forward portion having a third width less than said second width, said third width providing a clearance for said forward tab.

4. A shelf assembly in accordance with claim 3 wherein said forward and rear tab extend laterally outward from said shelf first side, said first side support ledge extends laterally inward over said forward and rear tab when said shelf is in a retracted position.

5. A slide-out refrigerator shelf assembly comprising:

a shelf comprising a first side, a forward tab laterally extending a first distance from said first side, and a rear tab laterally extending a second distance from said first side, said second distance less than said first distance; and a first shelf side support comprising a laterally projecting ledge for sliding engagement with said shelf first side, said projecting ledge comprising:

a rear portion having a first width sufficient to retain said rear tab, wherein said rear tab is configured to be under said rear portion when said shelf is in a first extended position;

a center portion having a second width less than said first width and providing a clearance for said rear tab, wherein said shelf forward tab is configured to be forward of said rear portion and said center portion when said shelf is in said first extended position; and a forward portion having a third width less than said second width, said third width providing a clearance for said forward tab.

6. A shelf assembly in accordance with claim 5 wherein said rear tab is configured to be forward of said ledge rear portion when said shelf is in a release position.

7. A shelf assembly in accordance with claim 6 wherein said support further comprises a vertically extending tab configured to contact said forward tab when said shelf is in said first extended position.

8. A shelf assembly in accordance with claim 7, wherein said tab is configured to prevent said forward tab from moving forwardly from said first extended position until a front edge of said shelf is raised.

* * * * *